US005749107A

United States Patent [19]

Hansen et al.

[11] Patent Number: 5,749,107

[45] Date of Patent: May 12, 1998

[54] SPA APPARATUS WITH HANGING STRUCTURAL LINER

[75] Inventors: Borg Hansen, Long Beach; Rafael Gonzalez, Palmdale; Roc V. Fleisaman, Venice, all of Calif.

[73] Assignee: Softub, Inc., Chatsworth, Calif.

[21] Appl. No.: 813,047

[22] Filed: May 8, 1997

Related U.S. Application Data

[62] Division of Ser. No. 661,029, Jun. 10, 1996.

[51] Int. Cl.[6] ..... A47K 3/00

[52] U.S. Cl. ..... 4/541.1; 4/584

[58] Field of Search ..... 4/541.1, 506, 559, 4/580, 584

[56] References Cited

U.S. PATENT DOCUMENTS

| | | | |
|---|---|---|---|
| D. 51,506 | 11/1917 | Miyahara . | |
| D. 252,042 | 6/1979 | Jacuzzi . | |
| D. 264,129 | 4/1982 | Tulipani . | |
| D. 274,455 | 6/1984 | Cuttriss . | |
| D. 293,363 | 12/1987 | Everard . | |
| 446,164 | 2/1891 | Doelle | 4/580 |
| 550,542 | 11/1895 | Smith | 4/580 |
| 817,314 | 4/1906 | Hahn . | |
| 933,954 | 9/1909 | Brattin . | |
| 1,450,444 | 4/1923 | McGuire . | |
| 1,941,832 | 1/1934 | Gottfried . | |
| 1,955,022 | 4/1934 | Rodman . | |
| 2,733,711 | 2/1956 | Gibson . | |
| 2,734,459 | 2/1956 | Zimsky . | |
| 2,805,426 | 9/1957 | Rempel . | |
| 2,844,825 | 7/1958 | Gauerke . | |
| 3,157,774 | 11/1964 | Moore et al. . | |
| 3,300,355 | 1/1967 | Adams . | |
| 3,337,384 | 8/1967 | Wright . | |
| 3,396,412 | 8/1968 | Francom . | |
| 3,571,818 | 3/1971 | Jacuzzi . | |
| 3,720,964 | 3/1973 | Thomson . | |
| 3,734,811 | 5/1973 | Small et al. . | |
| 3,772,714 | 11/1973 | Sealby et al. . | |
| 3,886,936 | 6/1975 | Wehrenberg . | |
| 3,923,573 | 12/1975 | Hay, II . | |
| 3,943,580 | 3/1976 | Carter . | |
| 3,970,210 | 7/1976 | Katsuta . | |
| 4,118,814 | 10/1978 | Holtom . | |
| 4,349,434 | 9/1982 | Jaworski . | |
| 4,546,900 | 10/1985 | Lackey . | |
| 4,564,962 | 1/1986 | Castleberry et al. . | |
| 4,579,617 | 4/1986 | Oberg et al. . | |
| 4,658,448 | 4/1987 | Rogers et al. . | |
| 4,679,545 | 7/1987 | Cavestany . | |
| 4,699,288 | 10/1987 | Mohan . | |
| 4,829,607 | 5/1989 | Huse . | |
| 4,843,659 | 7/1989 | Popovich et al. . | |
| 4,858,254 | 8/1989 | Popovich et al. . | |
| 4,901,379 | 2/1990 | Chalberg et al. . | |
| 4,981,543 | 1/1991 | Popovich et al. . | |
| 5,022,101 | 6/1991 | Gosselin et al. . | |
| 5,092,951 | 3/1992 | Popovich et al. . | |
| 5,428,849 | 7/1995 | Watkins et al. . | |
| 5,454,195 | 10/1995 | Hallsten . | |
| 5,548,852 | 8/1996 | Rowe . | |

FOREIGN PATENT DOCUMENTS

| | | |
|---|---|---|
| 312885 | 4/1989 | European Pat. Off. . |
| 1227969 | 4/1960 | France . |
| 2087513 | 12/1971 | France . |
| 3204323 | 8/1983 | Germany . |
| 3320617 | 7/1984 | Germany . |
| 3602771 | 10/1986 | Germany . |
| 3610823 | 7/1987 | Germany . |
| 4032448 | 1/1992 | Germany . |
| 6142156 | 5/1994 | Japan . |
| 904763 | 8/1962 | United Kingdom . |
| 1381723 | 1/1975 | United Kingdom . |
| 1592982 | 7/1981 | United Kingdom . |
| 2171008 | 8/1986 | United Kingdom . |

*Primary Examiner*—David J. Walczak
*Attorney, Agent, or Firm*—William W. Haefliger

[57] ABSTRACT

The method of providing a spa tub, and comprising providing a load-bearing tub side wall having an inner side and an outer side, the tub having an interior to receive liquid; the tub side wall provided to include at least two wall sections, spaced about the interior, the sections assembled end-to-end to form the side wall to extend in a loop, and providing a flexible liner extending at the inner side of said side wall to contain said liquid.

14 Claims, 9 Drawing Sheets

SPA APPARATUS WITH HANGING STRUCTURAL LINER

This application is a division of prior U.S. application Ser. No. 08/661,029 filed Jun. 10, 1996.

BACKGROUND OF THE INVENTION

This invention relates generally to hot tubs or spas, more particularly to an easy to manufacture, low-cost, lightweight, insulated, semi-rigid plastic spa, which is made in multiple sections.

Conventional hot tubs or spas are bulky, heavy, non-portable, and expensive in their construction; Also, expensive electrical energy and heat energy is required for their operation. There is need for a greatly improved, easily fabricated and assembled spa structure, with the unusual advantages in construction, modes of operation, use and transport, and results, as are now made possible by the present invention, as will appear.

SUMMARY OF THE INVENTION

It is a major object of the invention to provide a method of forming an improved hot tub or spa, easy to assemble from multiple sections, and meeting the above needs. Basically, the method of the invention is accomplished by:

a) providing a load-bearing tub side wall having an inner side and an outer side, the tub having an interior to receive liquid, b) the tub side wall provided to include at least two wall sections, spaced about the interior, the sections assembled end-to-end to form the side wall to extend in a loop, c) and providing a flexible liner extending at the inner side of the side wall to contain the liquid.

As will be seen, the tub wall typically includes at least three of the wall sections, easily assembled end-to-end, with outer wall panel structures connected end-to-end, and with reinforcing inner wall panel structures also connected end to end. Cavities are provided in the tub wall; and water and air ducts are located in certain of such cavities. Also, there are typically six of the outer panel structures and six of the inner panel structures, each inner panel structure integrally joined to at least one outer panel structure. Bridges or webs are typically provided at different elevations to define the cavities, which may be cored.

Another object is to provide retention band means extending in a loop about the interconnected sections, to resist their outward deflection.

A further object is to provide the inner liner to be supported by the side wall to extend in a loop to contain transmission toward the side wall of liquid pressure exerted by liquid in the interior. As will be seen, the liner typically hangs to extend vertically and is spaced from the inner side of the side wall to contain liquid, such as water, filled into the tub interior.

An additional object includes provision of a flexible, outer jacket for the side wall, the jacket extending upwardly to a top cap and cover for the side wall.

Yet another object is to construct the spa in multiple sections which can be assembled end-to-end, and held together by strapping enabling disassembly for storage of the sections, and employing a hanging structural liner in the spa to retain spa water, within the assembled sections.

A further object is to provide a water or liquid filter, and supporting the filter in the space between the hanging liner and the side wall inner side, there being an access opening provided to the filter via the hanging liner. A local enclosure is provided in the space, to container the filter, and an opening is provided in the inner liner to pass water to the filter. A water heater may be employed in that space.

These and other objects and advantages of the invention, as well as the details of an illustrative embodiment, will be more fully understood from the following specification and drawings, in which:

DRAWING DESCRIPTION

DETAILED DESCRIPTION

Figure 1:
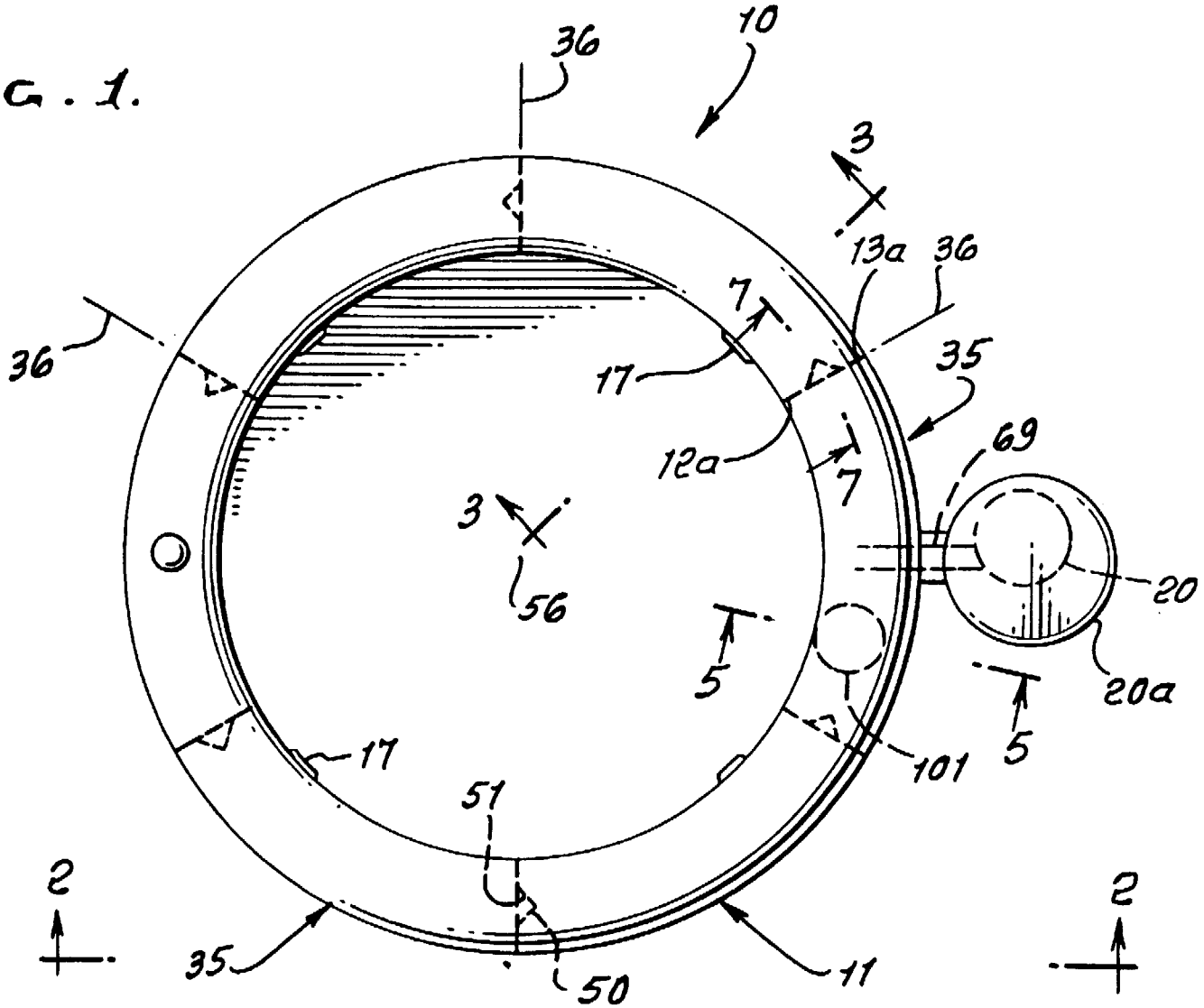
FIG. 1 is a top plan view of a hot tub or spa incorporating the invention.
Figure 2:
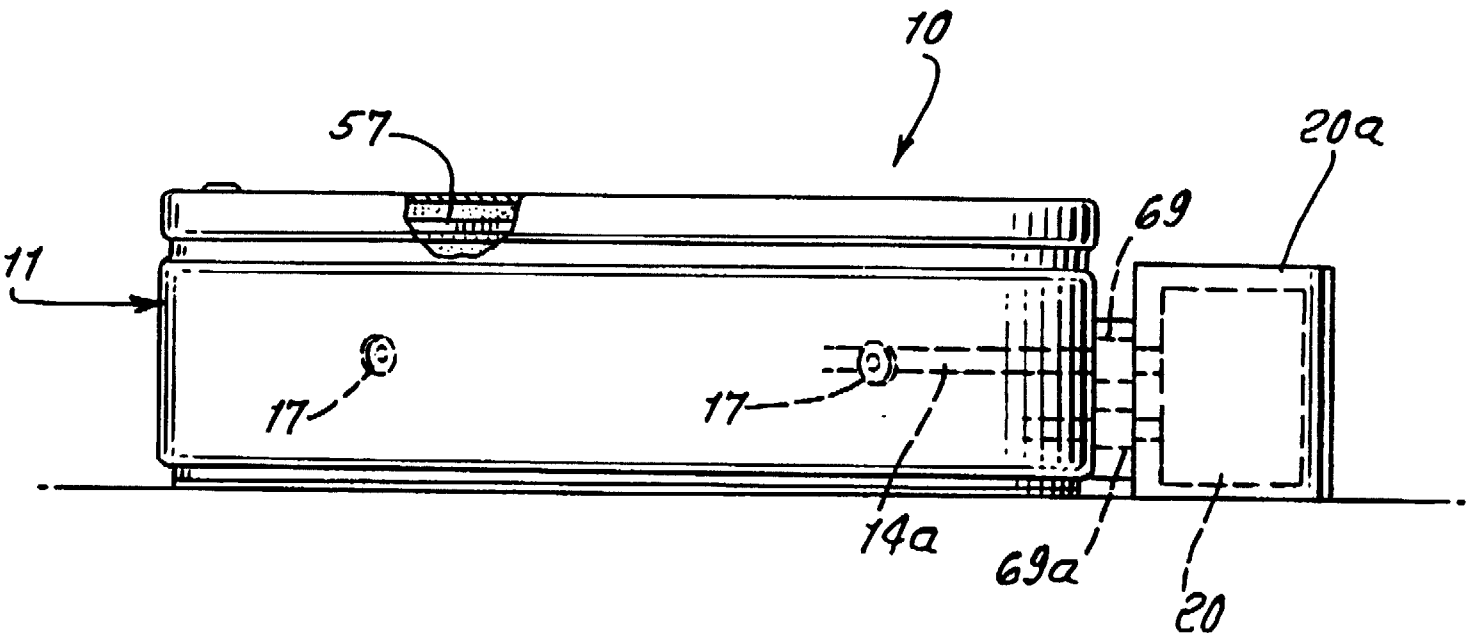
FIG. 2 is a side elevation view of the FIG. 1 hot tub or spa.

In FIGS. 1–6, a tub or spa 10 has a looping, upstanding, self-supporting, lightweight side wall 11. The wall includes an inner panel structure or structures 12, inwardly of vertical plane 12*a*, and an outer panel structure or structures 13. These structures 12 and 13, extend upright throughout substantially the entire height of the side wall 11. Such panel structures typically consist of synthetic resin, and examples are foamed or gas-expanded polystyrene, and foamed or gas-expanded polypropylene, formed as molded and curved blocks or sections that interfit end-to-end, as for example is shown in FIG. 7, and may be adhesively bonded together at their interfit locations. The sections may be held together by strapping, to form a tight unit, and to enable their disassembly, if the section ends are not adhesively bonded. Structures 12 and 13 of each wall section 35 are typically molded as one unit, i.e., are interconnected.

For example, six such sector-shaped inner panels 13 may be interconnected end to end in a loop, as by adhesive bonding, to define the looping tub wall. Note that two or more of the sections may be adhesively bonded to form section combinations, such as, for example, two combinations, each formed by three sections bonded end to end. The two combinations may be easily stored after disassembly. Panel structures 12 are cored, as shown, and thicker than panel structures 13. Panel structures 12 have end-to-end interconnection at joints 12*a*, inwardly of joints 13*a*. Looping space or spaces are formed, as at 14 in inner panel structures 12; and cored spaces are formed, as at 15 and 150 in the inner panel structures. See FIG. 4. See also spaced vertical webs or bridges 160, 161 and 162; and spaced horizontal webs or bridges 163–166.

Looping space 14 is adapted to receive ducting 14*a*, seated on bridges 165, for flowing water under pressure, as to jet nozzles 17. Ducting 15*a* flows air to the nozzles 17 that communicate through the hanging structural liner 95, for delivery of aerated water jets to the tub interior 18 bounded by the liner 95, which is spaced at 96 from the wall 11, i.e., from inner terminals 163a–166a of bridges 163–166. Air is typically supplied for mixing with water, as for example was disclosed in U.S. Pat. Nos. 4,858,254 and 4,843,659, incorporated herein by reference. Jet orifice plates are shown at 192. See U.S. patent application Ser. No. 08/336,738, incorporated herein by reference. Air is supplied to line 15a from an inlet at a warm air zone in a power pack that includes a water pump and motor drive, as disclosed in the patents, and the application. Such equipment is indicated at 16 in FIG. 3.

As appears in FIG. 1, the six sector-shaped wall sections 35 are generally alike and assembled end-to-end, to form a looping, upstanding, unitary self-supporting, tub wall 11, capable of disassembly for storage, if all the sections are not adhesively connected. The ends of the outer panel structures are located at six radial axial planes 36; and the end locations of the inner panel structures are also located at six radial axial planes, as at 36.

Figure 3:
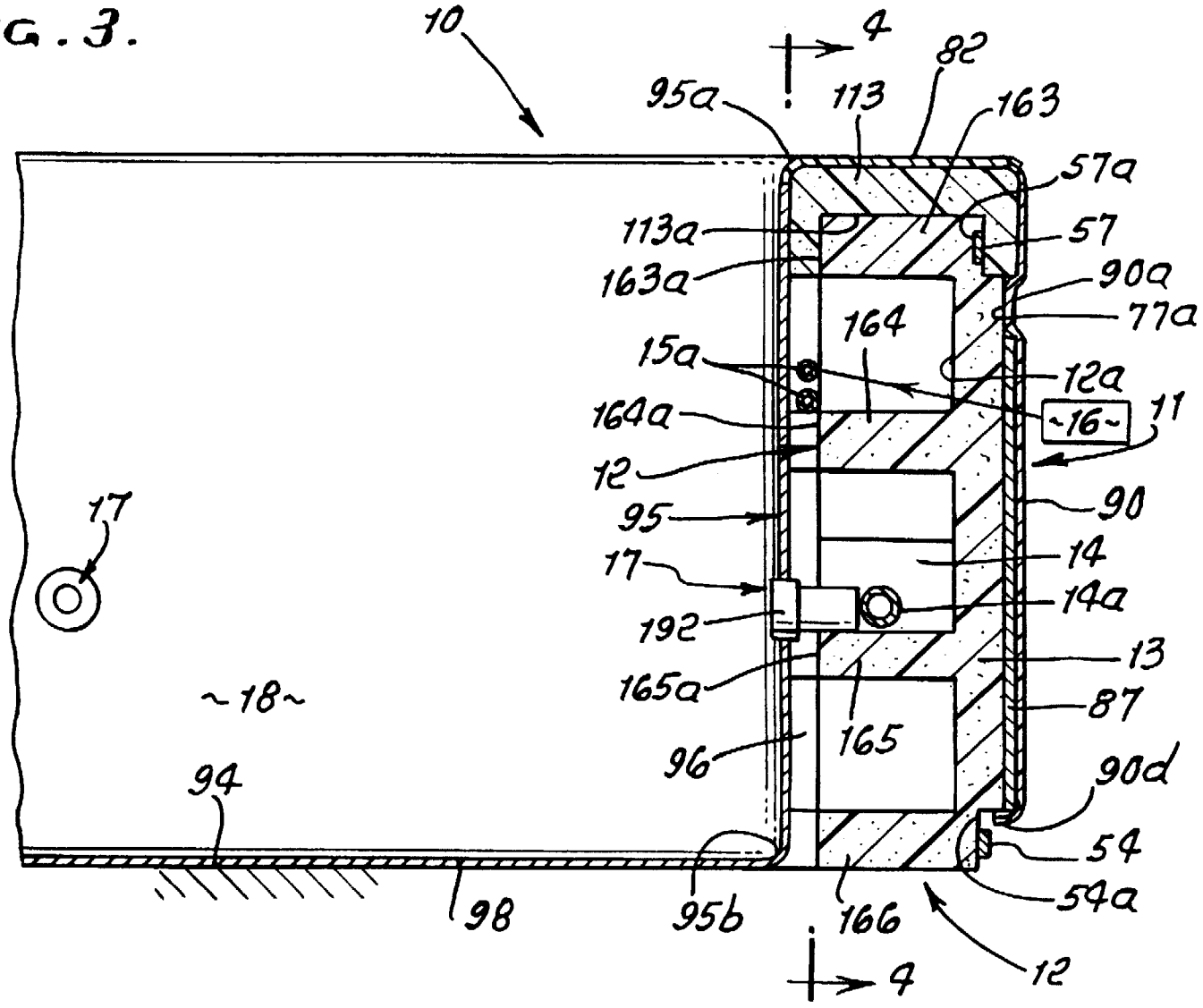
FIG. 3 is an enlarged vertical, radial section taken through the tub wall, and taken on lines 3—3 of FIG. 1.

The six sector-shaped panel structures 12 have circularly projecting tongues 50 and grooves 51 located at their opposite ends, as seen in FIG. 7. Tongues 50 of circularly successive sections 35 interfit in grooves 51, as shown. Such tongues and grooves may be located at interfitting ends of bridges 163–166 of the successive sections 35. When the inner panel structures 12 are interlocked, or otherwise connected, as described, the outer panel structure 13, as referred to above, have end-to-end interfit. The panel assembly is, therefore, capable of transmitting hoop compressive loading. As seen in FIG. 3, such loading is effected as by a holding element, such as a tightenable or loosenable looping fiberglass tape or metallic strap 54 received in lower grooves or channels 54a in the outer sides of panel structures 13, i.e., that extend about the central axis 56 of the tub.

A similar compressive, load-exerting, looping, holding element 57 may be received in upper channels or grooves 57a formed in the outer sides of panel structures 13, to extend about the central axis 56. Strap 54 is outward of bridges 166; and strap 57 is outward of bridges 163. Therefore, hoop loading is transmitted via opposite ends of bridges 163 and of bridges 166.

A source of fluid, such as a water pump 20, within pumping unit 20a, circulates water under pressure, as at 69, to the ducts 14a for delivery to the jet nozzles 17, as referred to. Return ducting 69a from one section 35, re-circulates water from the tub interior to the pump unit. See for example the pump unit and circulation path, as shown in U.S. Pat. No. 5,092,951, incorporated herein by reference.

Referring to FIG. 3, an inverted, channel-shaped support or caps is provided at 113 to provide a comfortable arm rest, or seat, for the tub user, as for example during climbing into or out of the tub. The upper surface of the support is shown as upwardly flat, in axial radial planes; and it may extend in a complete horizontal loop, and over and in association with the tub looping upstanding wall 11, to rigidize the structure. Bridge 163 fits in the cap channel 113a.

An outer, flexible jacket is shown at 90 in FIG. 3, and extends adjacent or near to the outer side of the tub wall 11. Specifically, it is shown as conforming closely to the shape of an outer, vertical pad 87, i.e., extending downwardly adjacent that pad. The annular jacket 90 preferably consists of a thin sheet of marine grade polyvinyl material or similar protective outdoor fabric; and pad 87 may consist of foam plastic material. The upper edge extent 90a of the sheet is received in a recess 77a formed above pad 87. The lower annular edge extent 90d of the outer jacket is turned inward to fit in recess 54a. The upper end of the jacket is attached to or integral with a top cover or top liner 82 covering the top of cap 113, as shown.

Accordingly, the jacket 90 has multiple functions, i.e., it protectively covers the outer side of the tub side wall; it is retained to top cover 82; it protectively covers the outer padding 87; and it is retained to the tub wall lower extent at recess 54a, as referred to.

Inner structural liner 95 seen in FIG. 3 hangs from top cover 82 and is spaced at 96 from the inner side of the tub wall 11, i.e., inner surfaces 163a–166a of the bridges. The liner 95 preferably consists of a sheet of waterproof, flexible, polyvinyl material, or similar waterproof, flexible sheet. Upper edge extent 95a of the sheet is attached to or integral with the cover 82. The lower edge extent 95b of liner sheet 95 meets and is bonded to (by RF weld or heat weld) the bottom vinyl sheet 98 protectively (and waterproof) forming the bottom wall of the tub, as on a floor surface 94. This enables easy and quick tub assembly, since after the wall sections are set up in a loop, and annular support 113 applied downwardly over the wall top, the liner material may be quickly applied to the wall 11, with inner liner 95 hanging, as shown.

Figure 4:
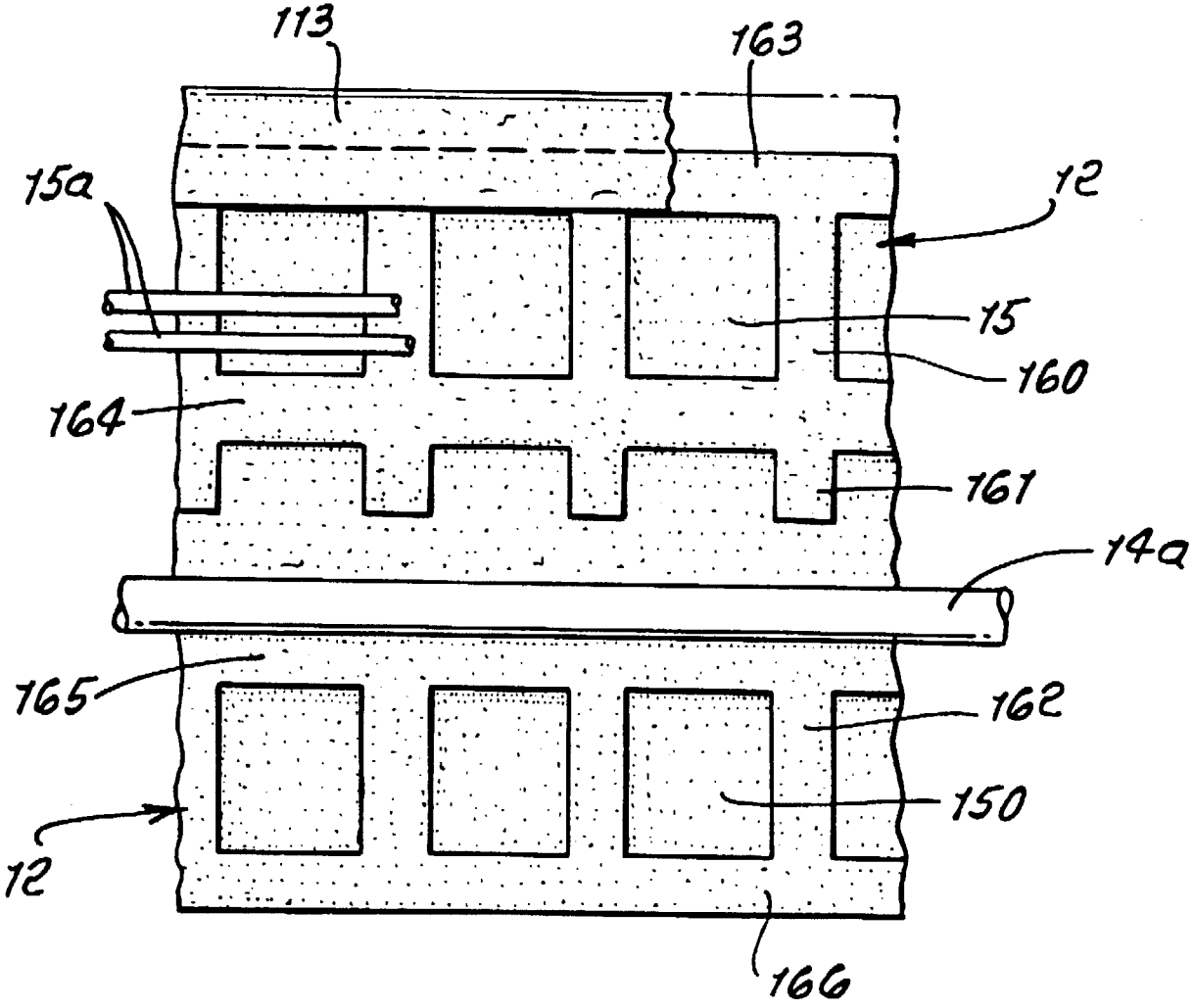
FIG. 4 is a vertical section taken on lines 4—4 of FIG. 3.
Figure 5:
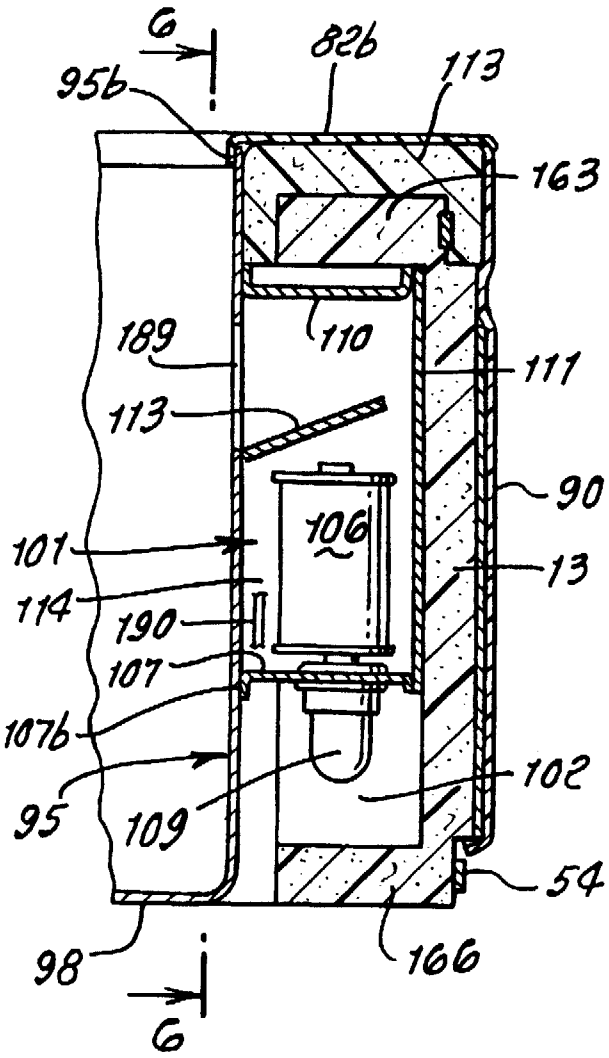
FIG. 5 is an enlarged vertical, radial section taken on lines 5—5 of FIG. 1.

FIGS. 1, 4 and 5 show tub associated mechanical equipment, such as a filter unit 101, received in a vertically elongated space 102 formed adjacent the panel 13 of an outer section 35 of the spa tub. Space 102 is located below a top bridge or web 163, and above a lowermost bridged web 166, as shown. The unit 101 may be at least partly carried or supported by the hanging structural liner 95, the top of which is connected at 95b to a top annular cover 82b, covering cap 113. See in this regard the upright filter body 106 supported by a panel 107, and attachment of the latter at 107b to the hanging liner. Ducting 109 is located below and communicates with the filter, to receive filtered water and to flow it to the pump unit.

Figure 6:
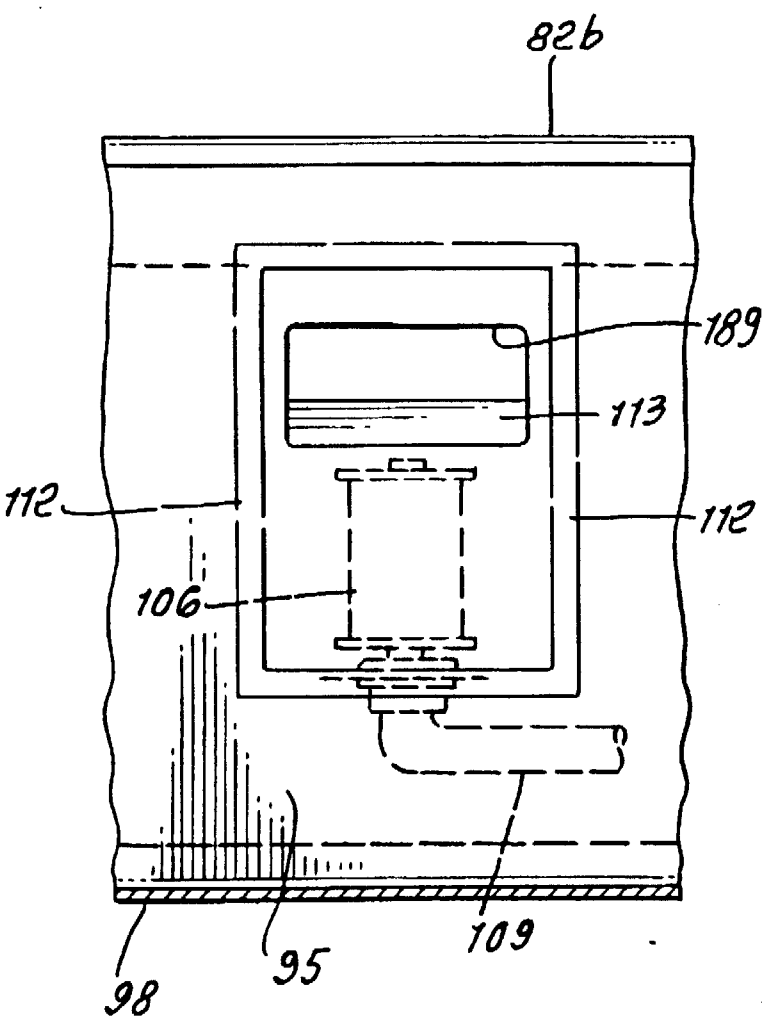
FIG. 6 is a vertical section taken on lines 6—6 of FIG. 5.
Figure 7:
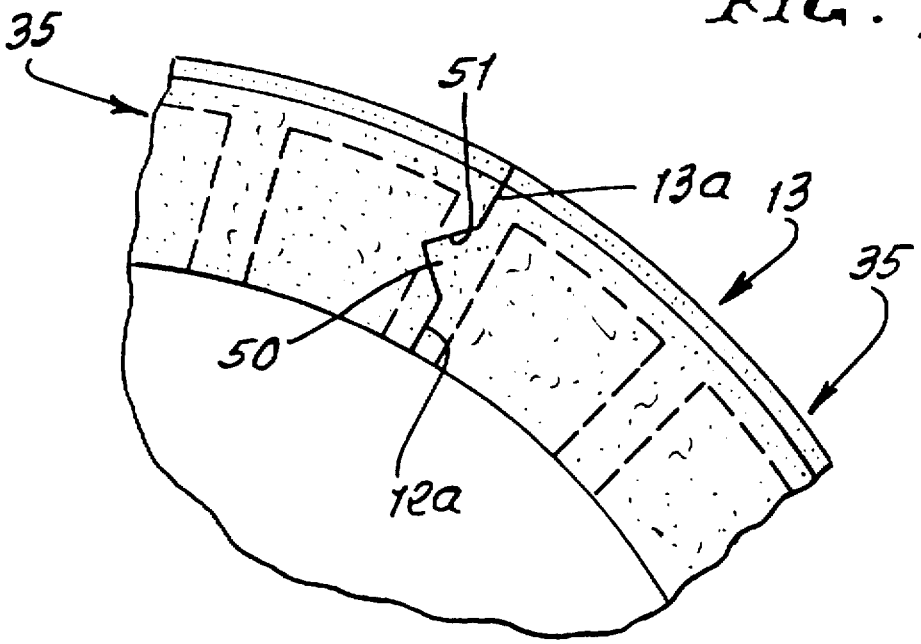
FIG. 7 is an enlarged horizontal section taken on lines 7—7 of FIG. 1.

An enclosure for the filter is shown to include upper panel 110, inner vertical panel 111 adjacent wall panel 13, and side panels 112 seen in FIG. 6. A weir panel or plate extends at 113 to define the top level of water in the tub interior, i.e., excess water flows over the weir and passes to the enclosure chamber 114 containing the filter, for flow through the latter. A water access opening through the liner is shown at 189.

Note that hanging liner 95 is structural, in that it at least partly supports the filter unit, it acts as the barrier to water in the tub, and it supports jets 17, as seen in FIG. 3. Bridge surfaces 164a and 165a limit outward local deflection of the hanging liner, as may occur as a bather moves against the liner in the tub. Jets 17 connected to ducting 14a, and carried by the liner, tend to resist deflection of the liner 95.

Figure 8:
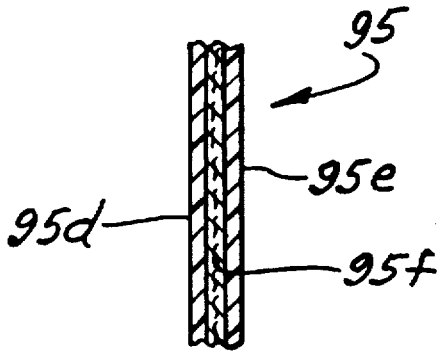
FIG. 8 is a fragmentary section showing reinforced construction of a hanging inner liner.

FIG. 8 shows a reinforced construction of the hanging structural liner, i.e., with inner and outer vinyl layers 95d and 95e, and a heavier reinforced inner layer 95f therebetween. FIG. 5 also shows a water heater coil 190 in space 114.

Figure 9:
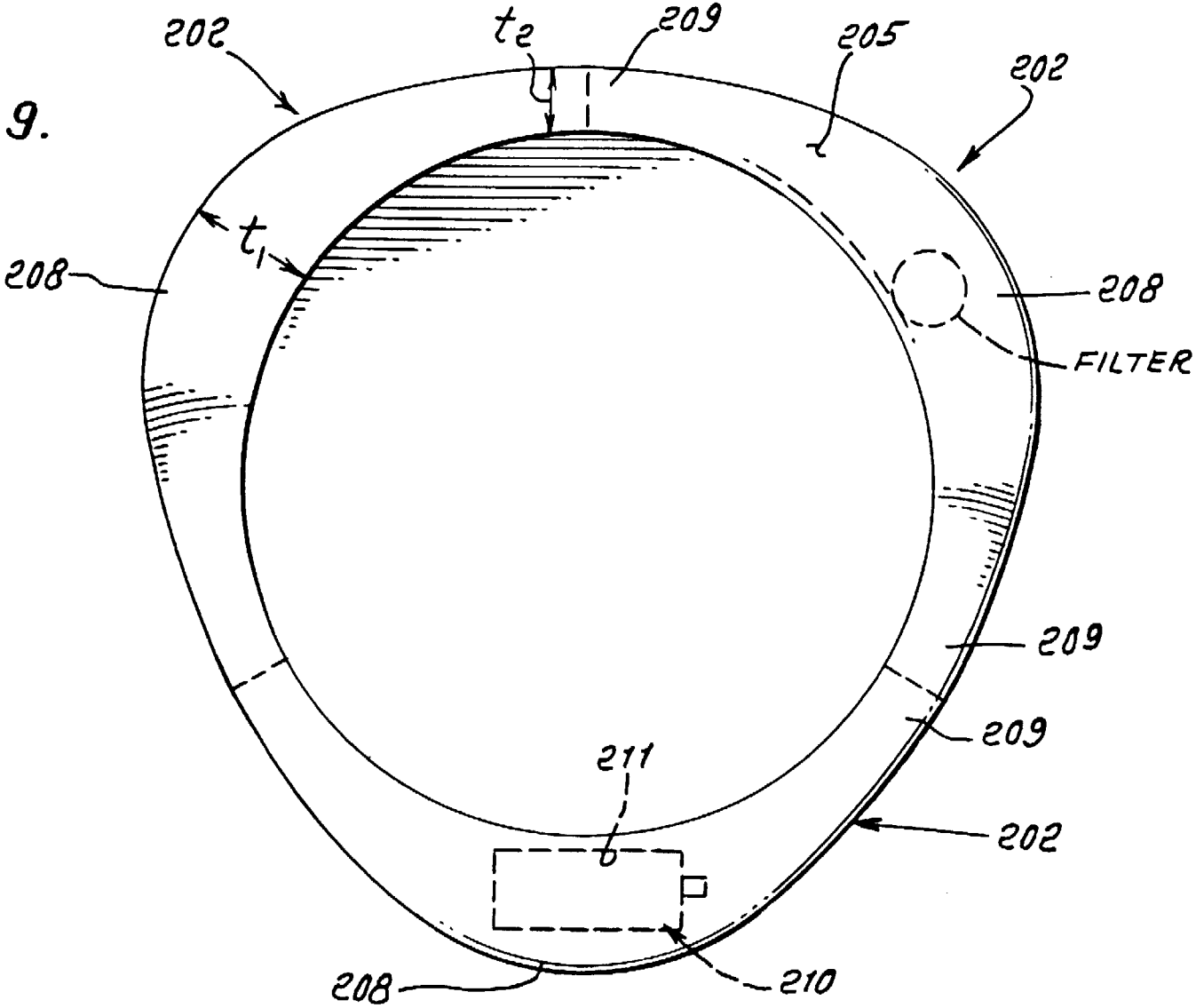
FIG. 9 is a diagrammatic plan view of a modification.
Figure 10:
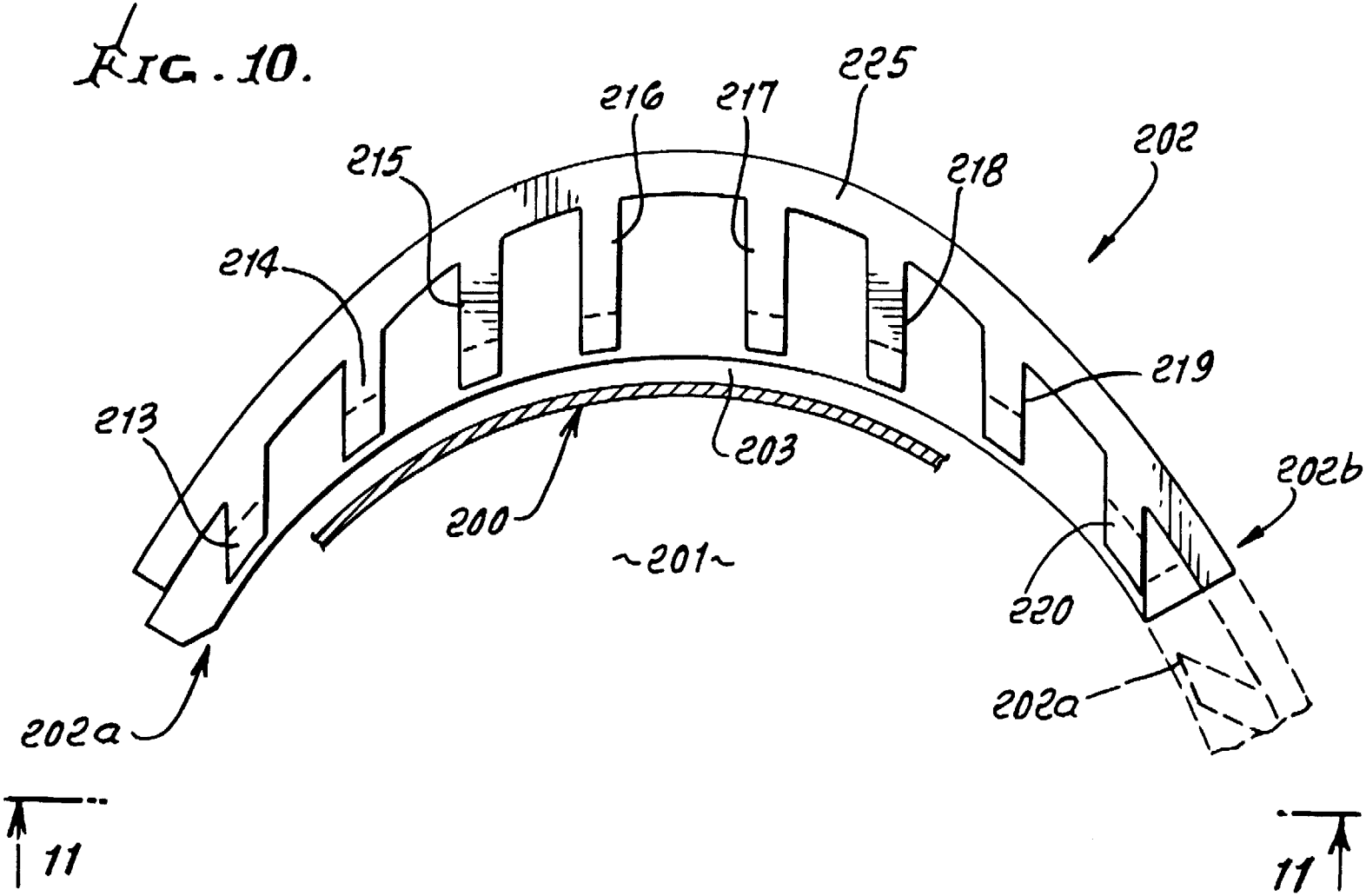
FIG. 10 is an enlarged fragmentary plan view taken in section of a portion of FIG. 9.
Figure 11:
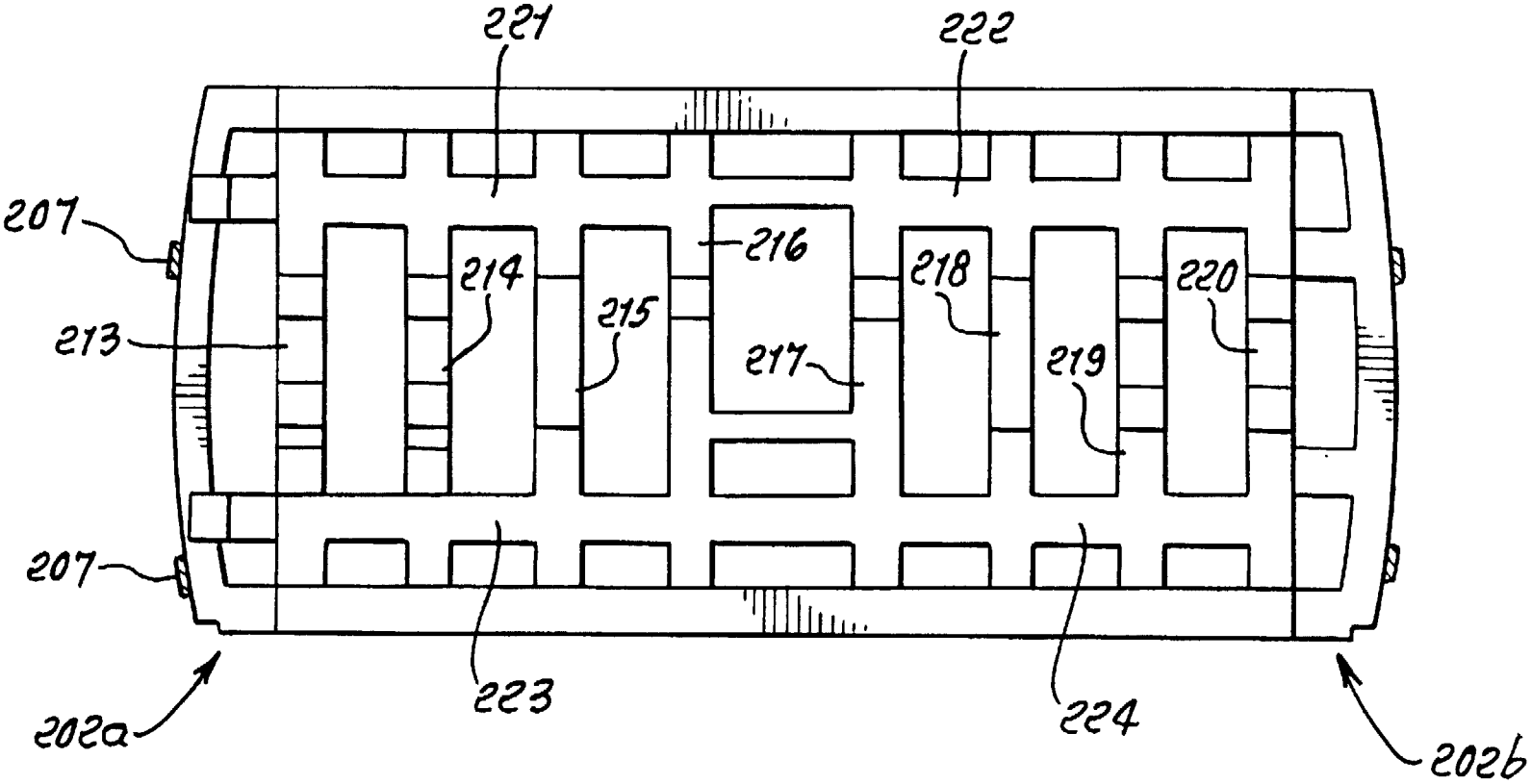
FIG. 11 is an elevation taken on lines 11—11 of FIG. 10.

FIGS. 9–11 show a modification of the invention, and characterized by:

a) a flexible structural liner 200 bounding a water-receiving inner zone 201 to contain sidewardly exerted hydraulic water loading;

b) an assembly of three panels 202 or panel units, bounding the liner at locations spaced from the liner, whereby an air space 203 is maintained between the liner and the panel assembly;

c) the panel assembly providing insulation (the panel 202 consisting of molded plastic material), and cooperating to locate the liner, which has oval configuration, the spa tub itself being shown to have modified triangular configuration, in plan view, for great strength and ease of assembly of the three panels or units 202 shown.

The panel assembly shown locates the liner and supports is uppermost looping extent; and the panel assembly is typically sufficiently stiff to provide load carrying capability, to support bathers seated on the uppermost ledge extent 205 of the assembly.

As seen in FIG. 11, the three panels 202 have ends 202*a* and 202*b* that interfit; and they may interconnect, as by adhesive, mechanical lock, or by straps 207 seen in FIG. 11, that loop about the outer sides of the panels.

As seen in FIG. 9, the panels define three corner regions 208, and walls 209, extending between those corners. The corner regions have maximum thickness "$t_1$" greater than the thickness "$t_2$" of the walls intermediate the corner regions. One such corner region is shown in FIG. 9 as containing a water pump unit 210, in a containment cavity 211, whereby unsightly external installation of the unit 210 is avoided.

Panel units 202 have spaced ribs 213–224 as shown, integral with panel outer wall structure 225.

We claim:

1. A spa tub comprising, in combination, a) a flexible structural liner bounding a water-receiving zone to contain hydraulic loading exerted by water in said zone, b) a panel assembly bounding said liner at locations spaced from the liner, whereby an air space is maintained between the liner and said panel assembly, c) the panel assembly providing insulation, and locating the liner, the panel assembly sufficiently stiff to provide load-carrying capability for people seated on the panel assembly, d) and including structure supported in said air space, there being an access opening provided to said space via said hanging liner, said structure including one of the following:

i) a water filter ii) a water pump.

2. The combination of claim 1 wherein the panel assembly includes multiple panels retained in assembled relation.

3. The combination of claim 2 wherein said panel assembly includes inner and outer panel structures, there being cavities in at least one of said structures, and liquid ducting in certain of said cavities.

4. The combination of claim 2 including at least one of the following acting to hold the panels in assembled relation:

i) adhesive material ii) mechanical interfit of panels iii) looping strap means iv) a combination of at least two of i), ii) and iii).

5. The combination of claim 1 wherein said spa tub has three, and only three, corner regions, whereby the spa tub has modified triangular configuration.

6. A spa tub comprising in combination, a) a flexible structural liner bounding a water-receiving zone to contain hydraulic loading exerted by water in said zone, b) a panel assembly bounding said liner at locations spaced from the liner, whereby an air space is maintained between the liner and said panel assembly, c) the panel assembly providing insulation, and locating the liner, the panel assembly sufficiently stiff to provide load-carrying capability for people seated on the panel assembly, d) said spa having three, and only three, corner regions, whereby the spa tub has modified triangular configuration, e) and wherein said spa tub defines walls extending between said corner regions, said corner regions having maximum thickness which is greater than the thickness of said walls extending intermediate the corner regions.

7. The combination of claim 6 including a pump motor contained within one of said corner regions.

8. The combination of claim 1 wherein said liner is supported by the panel assembly to extend in a loop to contain pressure exerted by water in said zone and toward said air space.

9. The combination of claim 1 wherein said panel assembly includes multiple lightweight, molded, plastic panels.

10. The combination of claim 9 wherein said panels have opposite ends, the panels extending in end adjacent relation to form a loop.

11. The combination of claim 9 wherein the flexible liner hangs generally vertically throughout its major vertical extent, adjacent said air space.

12. A spa tub comprising in combination, a) a flexible structural liner bounding a water-receiving zone to contain hydraulic loading exerted by water in said zone, b) a panel assembly bounding said liner at locations spaced from the liner, whereby an air space is maintained between the liner and said panel assembly, c) the panel assembly providing insulation, and locating the liner, the panel assembly sufficiently stiff to provide load-carrying capability for people seated on the panel assembly, d) said panel assembly including multiple lightweight, molded, plastic panels, e) said flexible liner hanging generally vertically throughout its major vertical extent, adjacent said air space, f) and including a water filter supported in said air space, there being an access opening provided to said filter via said hanging liner.

13. The combination of claim 9 wherein said panels consist of at least one of the following:

i) foamed polystyrene ii) foamed polyethylene iii) foamed polypropylene.

14. The combination of claim 1 including a cushioned cap extending over said panel assembly and upwardly of said liner, the liner freely hanging downwardly of said cap.

* * * * *

UNITED STATES PATENT AND TRADEMARK OFFICE

CERTIFICATE OF CORRECTION

PATENT NO. : 5,749,107

DATED : May 12, 1998

INVENTOR(S) : Borg Hansen, Rafael Gonzalez and Roc V. Fleishman

It is certified that error appears in the above-indentified patent and that said Letters Patent is hereby corrected as shown below:

On the title page, [75] Inventors: should read:

--Borg Hansen, Long Beach, Rafael Gonzalez, Palmdale; Roc V. Fleishman, Venice, all of Calif.--

Signed and Sealed this

Twenty-eighth Day of July, 1998

*Attest:*

Bruce Lehman

BRUCE LEHMAN

*Attesting Officer*

*Commissioner of Patents and Trademarks*